US009637710B2

(12) United States Patent
Hulskotter et al.

(10) Patent No.: US 9,637,710 B2
(45) **Date of Patent: *May 2, 2017**

(54) CLEANING COMPOSITION CONTAINING A POLYETHERAMINE

(71) Applicant: The Procter & Gamble Company, Cincinnati, OH (US)

(72) Inventors: Frank Hulskotter, Bad Duerkheim (DE); Patrick Firmin August Delplancke, Steenhuize-Wijnhuize (BE); Gloria Di Capua, Rome (IT); Bjoern Ludolph, Ludwigshafen (DE); Stefano Scialla, Rome (IT)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/700,174

(22) Filed: Apr. 30, 2015

(65) Prior Publication Data

US 2015/0315524 A1 Nov. 5, 2015

(30) Foreign Application Priority Data

Apr. 30, 2014 (EP) ..... 14166723

(51) Int. Cl.

| | |
|---|---|
| ***C11D 1/02*** | (2006.01) |
| ***C11D 1/75*** | (2006.01) |
| ***C11D 3/30*** | (2006.01) |
| ***C11D 3/37*** | (2006.01) |
| ***C11D 3/04*** | (2006.01) |
| ***C11D 3/33*** | (2006.01) |
| ***C11D 3/34*** | (2006.01) |
| ***C11D 1/83*** | (2006.01) |
| ***C11D 1/94*** | (2006.01) |
| ***C11D 11/00*** | (2006.01) |
| *C11D 1/14* | (2006.01) |
| *C11D 1/66* | (2006.01) |
| *C11D 3/28* | (2006.01) |
| *C11D 1/88* | (2006.01) |
| *C11D 1/29* | (2006.01) |

(52) U.S. Cl.

CPC ..... *C11D 3/3707* (2013.01); *C11D 1/83* (2013.01); *C11D 1/94* (2013.01); *C11D 3/046* (2013.01); *C11D 3/33* (2013.01); *C11D 3/349* (2013.01); *C11D 3/3723* (2013.01); *C11D 11/0035* (2013.01); *C11D 1/14* (2013.01); *C11D 1/29* (2013.01); *C11D 1/66* (2013.01); *C11D 1/75* (2013.01); *C11D 1/88* (2013.01); *C11D 3/28* (2013.01); *C11D 3/30* (2013.01)

(58) Field of Classification Search

CPC .... C11D 1/00; C11D 1/02; C11D 1/14; C11D 1/29; C11D 1/66; C11D 1/75; C11D 1/88; C11D 1/90; C11D 1/94; C11D 3/30; C11D 3/33; C11D 3/046; C11D 3/28; C11D 3/3481

USPC ..... 510/336, 337, 340, 350, 351, 352, 356, 510/357, 361, 477, 488, 499, 505, 506, 510/500, 492

See application file for complete search history.

(56) References Cited

U.S. PATENT DOCUMENTS

| | | | | |
|---|---|---|---|---|
| 2,509,197 | A | 5/1950 | Borus et al. | |
| 4,973,416 | A * | 11/1990 | Kennedy | C11D 3/30 510/296 |
| 5,990,065 | A | 11/1999 | Vinson et al. | |
| 6,069,122 | A | 5/2000 | Vinson et al. | |
| 6,362,147 | B1 | 3/2002 | Castro et al. | |
| 6,710,023 | B1 | 3/2004 | Bodet et al. | |
| 6,774,099 | B1 | 8/2004 | Scheibel et al. | |
| 9,193,939 | B2 * | 11/2015 | Hulskotter | C11D 3/0036 |
| 2004/0186034 | A1 * | 9/2004 | Verrall | C11D 17/043 510/296 |
| 2013/0053298 | A1 * | 2/2013 | Holzhauer | C11D 1/83 510/505 |
| 2014/0296124 | A1 * | 10/2014 | Hulskotter | C11D 3/0036 510/300 |
| 2015/0315524 | A1 * | 11/2015 | Hulskotter | C11D 3/3707 510/235 |

FOREIGN PATENT DOCUMENTS

| | | | |
|---|---|---|---|
| EP | 0 232 092 | A2 | 8/1987 |
| EP | 0 647 706 | A2 | 4/1995 |
| EP | 0 921 164 | A1 | 6/1999 |
| WO | WO98/28393 | * | 7/1998 |
| WO | WO 99/11746 | A1 | 3/1999 |
| WO | WO 99/63034 | A1 | 12/1999 |
| WO | WO00/63334 | * | 10/2000 |
| WO | WO 01/25379 | A1 | 4/2001 |

(Continued)

OTHER PUBLICATIONS

Extended European Search Report; Application No. 14166723.8; date of search Oct. 9, 2014; 5 pages.

Extended European Search Report; Application No. 14166724.6; date of search Oct. 7, 2014; 3 pages.

Extended European Search Report; Application No. 14166722.0; date of search Oct. 2, 2014; 3 pages.

(Continued)

*Primary Examiner* — Gregory R Delcotto

(74) *Attorney, Agent, or Firm* — Melissa Krasovec; Leonard W Lewis; Steven W Miller

(57) ABSTRACT

A hard surface cleaning composition comprising:

a) from 1% to 60% by weight of the composition of a surfactant system comprising an anionic surfactant and a primary co-surfactant selected from the group consisting of amphoteric, zwitteronic and mixtures thereof; and b) from 0.1% to 10% by weight of the composition of a polyetheramine.

13 Claims, No Drawings

(56) References Cited

FOREIGN PATENT DOCUMENTS

| | | | |
|---|---|---|---|
| WO | WO01/76729 | * | 10/2001 |
| WO | WO 01/76729 | A2 | 10/2001 |
| WO | WO 2012/011020 | A2 | 1/2012 |
| WO | WO 2012/126665 | A1 | 9/2012 |

OTHER PUBLICATIONS

Extended European Search Report; Application No. 14166720.4; date of search Dec. 9, 2014; 5 pages.
U.S. Appl. No. 14/700,176, filed Apr. 30, 2015, Hulskotter, et al.
U.S. Appl. No. 14/700,181, filed Apr. 30, 2015, Hulskotter, et al.
U.S. Appl. No. 14/700,194, filed Apr. 30, 2015, Hulskotter, et al.

* cited by examiner

CLEANING COMPOSITION CONTAINING A POLYETHERAMINE

TECHNICAL FIELD

The present invention relates generally to a cleaning composition and, more specifically, to a hard surface cleaning composition containing a polyetheramine that provides benefits in terms of the removal of greasy soils.

BACKGROUND OF THE INVENTION

The detergent formulator is constantly aiming to improve the performance of detergent compositions. One of the biggest challenges encountered in hard surface cleaning is the removal of greasy soils, in particular the removal of greasy soils from hydrophobic items such as plastic.

The challenge is not only to remove the grease from hydrophobic items but also to leave them feeling not greasy or slippery. Ideally, consumers like to clean items to achieve squeaky cleanness, i.e., the items are so clean that when a finger is slid along the item a squeaky noise is produced. This noise is associated with total cleanness.

The objective of the present invention is to provide a hand dishwashing composition with improved grease soil removal.

SUMMARY OF THE INVENTION

According to the first aspect of the invention there is provided a cleaning composition, preferably the composition is a hand dishwashing cleaning composition. The composition is preferably in liquid form. The composition comprises a surfactant system and a polyetheramine selected from the group consisting of polyetheramines of Formula (I), (II), (III) and a mixture thereof.

The composition of the invention provides excellent grease removal, even from hydrophobic items, such as plastics. The composition leaves even plastic items feeling squeaky clean.

The surfactant system of the composition of the invention comprises an anionic surfactant and a primary co-surfactant selected from the group consisting of amphoteric, zwitterionic and mixtures thereof.

The anionic surfactant can be any anionic cleaning surfactant, especially preferred anionic surfactants are selected from the group consisting of alkyl sulfate, alkyl alkoxy sufate, alkyl benzene sulfonate, paraffin sulfonate and mixtures thereof. Preferred anionic surfactants are selected from alkyl sulfate, alkyl alkoxy sulfate and mixtures thereof, a preferred alkyl alkoxy sulfate is alkyl ethoxy sulfate. Preferred anionic surfactant for use herein is a mixture of alkyl sulfate and alkyl ethoxy sulfate.

Extremely useful surfactant systems for use herein include those comprising anionic surfactants, in combination with amine oxide, especially alkyl dimethyl amine oxides, and/or betaine surfactants.

Another preferred surfactant system for use herein is an anionic and amphoteric/zwitterionic system in which the amphoteric to zwitterionic weight ratio is preferably from about 2:1 to about 1:2. In particular a system in which the amphoteric surfactant is an amine oxide surfactant and the zwitteronic surfactant is a betaine and the weight ratio of the amine oxide to the betaine is about 1:1.

Also preferred for use herein are surfactant systems further comprising non-ionic surfactants. Especially preferred nonionic surfactants are alkyl alkoxylated nonionic surfactants, especially alkyl ethoxylated surfactants.

Especially preferred surfactant systems for the composition of the invention comprise an anionic surfactant preferably selected from the group consisting of alkyl sulfate, alkyl alkoxy sulfate and mixtures thereof, more preferably an alkyl alkoxylated sulfate, and an amphoteric surfactant, preferably an amino oxide surfactant and a non-ionic surfactant. In summary, the most preferred surfactant system for use herein comprises an alkyl alkoxylated sulfate surfactant, amine oxide and non-ionic surfactant, especially an alkyl ethoxylated sulfate surfactant, alkyl dimethyl amine oxide and an alkyl ethoxylate nonionic surfactant.

Preferably, the composition of the invention comprises a salt of a divalent cation. In particular, a salt of magnesium. It has been found that magnesium cations can work in combination with the polyetheramine by strengthening and broadening the grease cleaning profile of the composition.

Preferably, the composition of the invention comprises a chelant. It has been found that chelants can act together with the polyetheramine of the invention to provide improved cleaning. Preferred chelants for use herein are aminophosphonate and aminocarboxylated chelants in particular aminocarboxylated chelants such as MGDA and GLDA.

Preferably, the composition of the invention comprises an isothiazolinone based preservative. The polyetheramines present good compatibility with this type of preservatives.

According to the second aspect of the invention there is provided a method of manually washing dishware using the composition of the invention. The composition of the invention is suitable for use in diluted or neat form. It is especially suited for use in neat form. There is provided the use of the composition of the invention for manually washing dishware to achieve squeaky cleanness.

DETAILED DESCRIPTION OF THE INVENTION

The present invention envisages a hard surface cleaning composition, preferably a hand dishwashing cleaning composition, comprising a surfactant system and a specific polyetheramine. The composition of the invention provides very good grease removal, in particular removal of vegetable/or animal based oils and greases. The invention also envisages a method of hand dishwashing and use of the composition to achieve squeaky cleanness.

The Cleaning Composition

The cleaning composition is preferably a hand dishwashing cleaning composition, preferably in liquid form. It typically contains from 30% to 95%, preferably from 40% to 90%, more preferably from 50% to 85% by weight of a liquid carrier in which the other essential and optional components are dissolved, dispersed or suspended. One preferred component of the liquid carrier is water.

Preferably the pH of the composition is from about 6 to about 12, more preferably from about 7 to about 11 and most preferably from about 8 to about 10, as measured at 25° C. and 10% aqueous concentration in distilled water. The cleaning amine of the invention performs better at a pH of from 8 to 10. The pH of the composition can be adjusted using pH modifying ingredients known in the art.

Polyetheramines

The cleaning compositions described herein include from about 0.1% to about 10%, preferably, from about 0.2% to about 5%, and more preferably, from about 0.5% to about 4%, by weight of the composition, of a polyetheramine.

One of the polyetheramine of the composition of the invention is represented by the structure of Formula (I):

Formula (I)

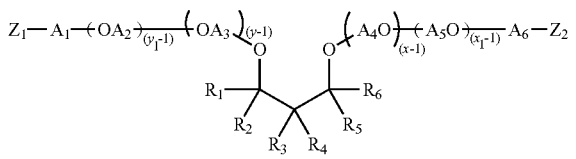

where each of $R_1$-$R_6$ is independently selected from H, alkyl, cycloalkyl, aryl, alkylaryl, or arylalkyl, where at least one of $R_1$-$R_6$ is different from H, typically at least one of $R_1$-$R_6$ is an alkyl group having 2 to 8 carbon atoms, each of $A_1$-$A_6$ is independently selected from linear or branched alkylenes having 2 to 18 carbon atoms, each of $Z_1$-$Z_2$ is independently selected from OH or $NH_2$, where at least one of $Z_1$-$Z_2$ is $NH_2$, typically each of $Z_1$ and $Z_2$ is $NH_2$, where the sum of x+y is in the range of about 2 to about 200, typically about 2 to about 20, more typically about 2 to about 10 or about 3 to about 8 or about 4 to about 6, where $x \geq 1$ and $y \geq 1$, and the sum of $x_1+y_1$ is in the range of about 2 to about 200, typically about 2 to about 20, more typically about 2 to about 10 or about 3 to about 8 or about 2 to about 4, where $x_1 \geq 1$ and $y_1 \geq 1$.

Preferably in the polyetheramine of Formula (I), each of $A_1$-$A_6$ is independently selected from ethylene, propylene, or butylene, typically each of $A_1$-$A_6$ is propylene. More preferably, in the polyetheramine of Formula (I), each of $R_1$, $R_2$, $R_5$, and $R_6$ is H and each of $R_3$ and $R_4$ is independently selected from C1-C16 alkyl or aryl, typically each of $R_1$, $R_2$, $R_5$, and $R_6$ is H and each of $R_3$ and $R_4$ is independently selected from a butyl group, an ethyl group, a methyl group, a propyl group, or a phenyl group. More preferably, in the polyetheramine of Formula (I), $R_3$ is an ethyl group, each of $R_1$, $R_2$, $R_5$, and $R_6$ is H, and $R_4$ is a butyl group. Especially, in the polyetheramine of Formula (I), each of $R_1$ and $R_2$ is H and each of $R_3$, $R_4$, $R_5$, and $R_6$ is independently selected from an ethyl group, a methyl group, a propyl group, a butyl group, a phenyl group, or H.

In the polyetheramine represented by the structure of Formula (II):

Formula (II)

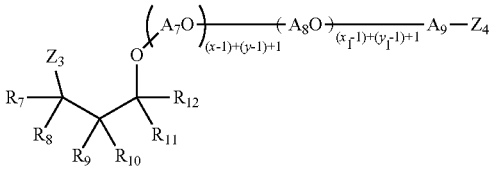

each of $R_7$-$R_{12}$ is independently selected from H, alkyl, cycloalkyl, aryl, alkylaryl, or arylalkyl, where at least one of $R_7$-$R_{12}$ is different from H, typically at least one of $R_7$-$R_{12}$ is an alkyl group having 2 to 8 carbon atoms, each of $A_7$-$A_9$ is independently selected from linear or branched alkylenes having 2 to 18 carbon atoms, each of $Z_3$-$Z_4$ is independently selected from OH or $NH_2$, where at least one of $Z_3$-$Z_4$ is $NH_2$, typically each of $Z_3$ and $Z_4$ is $NH_2$, where the sum of x+y is in the range of about 2 to about 200, typically about 2 to about 20, more typically about 2 to about 10 or about 3 to about 8 or about 2 to about 4, where $x \geq 1$ and $y \geq 1$, and the sum of $x_1+y_1$ is in the range of about 2 to about 200, typically about 2 to about 20, more typically about 2 to about 10 or about 3 to about 8 or about 2 to about 4, where $x_1 \geq 1$ and $y_1 \geq 1$.

Preferably in the polyetheramine of Formula (II), each of $A_7$-$A_9$ is independently selected from ethylene, propylene, or butylene, typically each of $A_7$-$A_9$ is propylene. More preferably, in the polyetheramine of Formula (II), each of $R_7$, $R_8$, $R_{11}$, and $R_{12}$ is H and each of $R_9$ and $R_{10}$ is independently selected from C1-C16 alkyl or aryl, typically each of $R_7$, $R_8$, $R_{11}$, and $R_{12}$ is H and each of $R_9$ and $R_{10}$ is independently selected from a butyl group, an ethyl group, a methyl group, a propyl group, or a phenyl group. More preferably, in the polyetheramine of Formula (II), $R_9$ is an ethyl group, each of $R_7$, $R_8$, $R_{11}$, and $R_{12}$ is H, and $R_{10}$ is a butyl group. In some aspects, in the polyetheramine of Formula (II), each of $R_7$ and $R_8$ is H and each of $R_9$, $R_{10}$, $R_{11}$, and $R_{12}$ is independently selected from an ethyl group, a methyl group, a propyl group, a butyl group, a phenyl group, or H.

Preferred polyetheramines are selected from the group consisting of Formula A, Formula B, and mixtures thereof:

Formula A

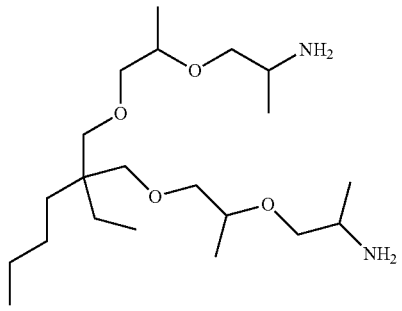

Formula B

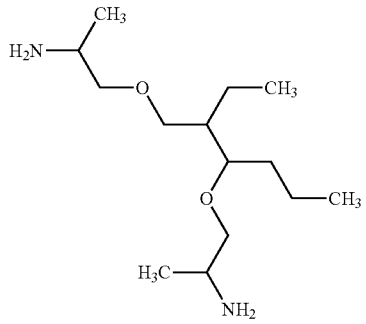

Preferably, the polyetheramine comprises a mixture of the compound of Formula (I) and the compound of Formula (II).

Typically, the polyetheramine of Formula (I) or Formula (II) has a weight average molecular weight of less than about grams/mole 1000 grams/mole, preferably from about 100 to about 800 grams/mole, more preferably from about 200 to about 450 grams/mole.

The polyetheramine can comprise a polyetheramine mixture comprising at least 90%, by weight of the polyetheramine mixture, of the polyetheramine of Formula (I), the polyetheramine of Formula(II), the polyetheramine of Formula(III) or a mixture thereof. Preferably, the polyetheramine comprises a polyetheramine mixture comprising at least 95%, by weight of the polyetheramine mixture, of the polyetheramine of Formula (I), the polyetheramine of Formula(II) and the polyetheramine of Formula(III).

The polyetheramine of Formula (I) and/or the polyetheramine of Formula(II), are obtainable by:

a) reacting a 1,3-diol of formula (1) with a $C_2$-$C_{18}$ alkylene oxide to form an alkoxylated 1,3-diol, wherein the molar ratio of 1,3-diol to $C_2$-$C_{18}$ alkylene oxide is in the range of about 1:2 to about 1:10, (1)

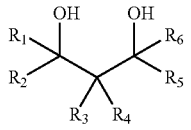

where $R_1$-$R_6$ are independently selected from H, alkyl, cycloalkyl, aryl, alkylaryl, or arylalkyl, where at least one of $R_1$-$R_6$ is different from H;

b) aminating the alkoxylated 1,3-diol with ammonia.

The molar ratio of 1,3-diol to $C_2$-$C_{18}$ alkylene oxide is preferably in the range of about 1:3 to about 1:8, more typically in the range of about 1:4 to about 1:6. Preferably, the $C_2$-$C_{18}$ alkylene oxide is selected from ethylene oxide, propylene oxide, butylene oxide or a mixture thereof. More preferably, the $C_2$-$C_{18}$ alkylene oxide is propylene oxide.

In the 1,3-diol of formula (1), $R_1$, $R_2$, $R_5$, and $R_6$ are H and $R_3$ and $R_4$ are $C_{1-16}$ alkyl or aryl. Preferably, the 1,3-diol of formula (1) is selected from 2-butyl-2-ethyl-1,3-propanediol, 2-methyl-2-propyl-1,3-propanediol, 2-methyl-2-phenyl-1,3-propanediol, 2,2-dimethyl-1,3-propandiol, 2-ethyl-1,3-hexandiol, or a mixture thereof.

Step a): Alkoxylation

The 1,3-diols of Formula (1) are synthesized as described in WO10026030, WO10026066, WO09138387, WO09153193, and WO10010075. Suitable 1,3-diols include 2,2-dimethyl-1,3-propane diol, 2-butyl-2-ethyl-1,3-propane diol, 2-pentyl-2-propyl-1,3-propane diol, 2-(2-methyl)butyl-2-propyl-1,3-propane diol, 2,2,4-trimethyl-1,3-propane diol, 2,2-diethyl-1,3-propane diol, 2-methyl-2-propyl-1,3-propane diol, 2-ethyl-1,3-hexane diol, 2-phenyl-2-methyl-1,3-propane diol, 2-methyl-1,3-propane diol, 2-ethyl-2-methyl-1,3 propane diol, 2,2-dibutyl-1,3-propane diol, 2,2-di(2-methylpropyl)-1,3-propane diol, 2-isopropyl-2-methyl-1,3-propane diol, or a mixture thereof. In some aspects, the 1,3-diol is selected from 2-butyl-2-ethyl-1,3-propanediol, 2-methyl-2-propyl-1,3-propanediol, 2-methyl-2-phenyl-1,3-propanediol, or a mixture thereof. Typically used 1,3-diols are 2-butyl-2-ethyl-1,3-propanediol, 2-methyl-2-propyl-1,3-propanediol, 2-methyl-2-phenyl-1,3-propanediol.

An alkoxylated 1,3-diol may be obtained by reacting a 1,3-diol of Formula I with an alkylene oxide, according to any number of general alkoxylation procedures known in the art. Suitable alkylene oxides include $C_2$-$C_{18}$ alkylene oxides, such as ethylene oxide, propylene oxide, butylene oxide, pentene oxide, hexene oxide, decene oxide, dodecene oxide, or a mixture thereof. In some aspects, the $C_2$-$C_{18}$ alkylene oxide is selected from ethylene oxide, propylene oxide, butylene oxide, or a mixture thereof. A 1,3-diol may be reacted with a single alkylene oxide or combinations of two or more different alkylene oxides. When using two or more different alkylene oxides, the resulting polymer may be obtained as a block-wise structure or a random structure.

Typically, the molar ratio of 1,3-diol to $C_2$-$C_{18}$ alkylene oxide at which the alkoxylation reaction is carried out is in the range of about 1:2 to about 1:10, more typically about 1:3 to about 1:8, even more typically about 1:4 to about 1:6.

The alkoxylation reaction generally proceeds in the presence of a catalyst in an aqueous solution at a reaction temperature of from about 70° C. to about 200° C. and typically from about 80° C. to about 160° C. The reaction may proceed at a pressure of up to about 10 bar or up to about 8 bar. Examples of suitable catalysts include basic catalysts, such as alkali metal and alkaline earth metal hydroxides, e.g., sodium hydroxide, potassium hydroxide and calcium hydroxide, alkali metal alkoxides, in particular sodium and potassium $C_1$-$C_4$-alkoxides, e.g., sodium methoxide, sodium ethoxide and potassium tert-butoxide, alkali metal and alkaline earth metal hydrides, such as sodium hydride and calcium hydride, and alkali metal carbonates, such as sodium carbonate and potassium carbonate. In some aspects, the catalyst is an alkali metal hydroxides, typically potassium hydroxide or sodium hydroxide. Typical use amounts for the catalyst are from about 0.05 to about 10% by weight, in particular from about 0.1 to about 2% by weight, based on the total amount of 1,3-diol and alkylene oxide.

Alkoxylation with x+y $C_2$-$C_{18}$ alkylene oxides and/or $x_1+y_1$ $C_2$-$C_{18}$ alkylene oxides produces structures as represented by Formula 2 and/or Formula 3:

Formula (2)

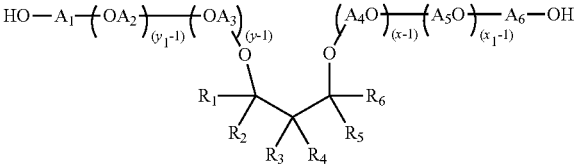

Formula (3)

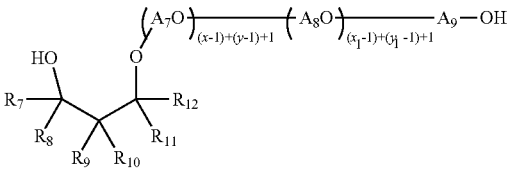

where $R_1$-$R_{12}$ are independently selected from H, alkyl, cycloalkyl, aryl, alkylaryl, or arylalkyl, where at least one of $R_1$-$R_6$ and at least one of $R_7$-$R_{12}$ is different from H, each of $A_1$-$A_9$ is independently selected from linear or branched alkylenes having 2 to 18 carbon atoms, typically 2-10 carbon atoms, more typically 2-5 carbon atoms, and the sum of x+y is in the range of about 2 to about 200, typically about 2 to about 20, more typically about 2 to about 10 or about 2 to about 5, where x≥1 and y≥1, and the sum of $x_1+y_1$ is in the range of about 2 to about 200, typically about 2 to about 20, more typically about 2 to about 10 or about 2 to about 5, where $x_1 \geq 1$ and $y_1 \geq 1$.

Step b): Amination

Amination of the alkoxylated 1,3-diols produces structures represented by Formula I or Formula II:

Formula I

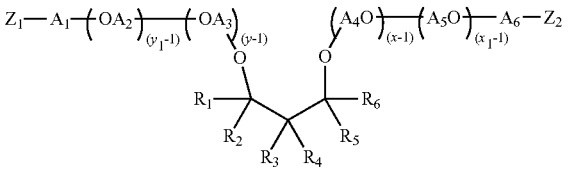

-continued

Formula (II)

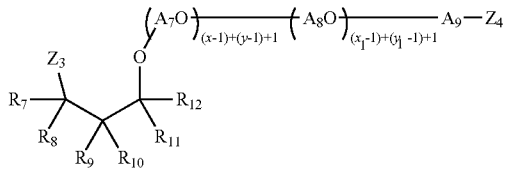

where each of $R_1$-$R_{12}$ is independently selected from H, alkyl, cycloalkyl, aryl, alkylaryl, or arylalkyl, where at least one of $R_1$-$R_6$ and at least one of $R_7$-$R_{12}$ is different from H, each of $A_1$-$A_9$ is independently selected from linear or branched alkylenes having 2 to 18 carbon atoms, typically 2-10 carbon atoms, more typically, 2-5 carbon atoms, each of $Z_1$-$Z_4$ is independently selected from OH or $NH_2$, where at least one of $Z_1$-$Z_2$ and at least one of $Z_3$-$Z_4$ is $NH_2$, where the sum of x+y is in the range of about 2 to about 200, typically about 2 to about 20, more typically about 2 to about 10 or about 2 to about 5, where x≥1 and y≥1, and the sum of $x_1+y_1$ is in the range of about 2 to about 200, typically about 2 to about 20, more typically about 2 to about 10 or about 2 to about 5, where $x_1 \geq 1$ and $y_1 \geq 1$.

Polyetheramines according to Formula I and/or Formula II are obtained by reductive amination of the alkoxylated 1,3-diol mixture (Formula 2 and Formula 3) with ammonia in the presence of hydrogen and a catalyst containing nickel. Suitable catalysts are described in WO 2011/067199A1, WO2011/067200A1, and EP0696572 B1. Preferred catalysts are supported copper-, nickel-, and cobalt-containing catalysts, where the catalytically active material of the catalyst, before the reduction thereof with hydrogen, comprises oxygen compounds of aluminum, copper, nickel, and cobalt, and, in the range of from about 0.2 to about 5.0% by weight of oxygen compounds, of tin, calculated as SnO. Other suitable catalysts are supported copper-, nickel-, and cobalt-containing catalysts, where the catalytically active material of the catalyst, before the reduction thereof with hydrogen, comprises oxygen compounds of aluminum, copper, nickel, cobalt and tin, and, in the range of from about 0.2 to about 5.0% by weight of oxygen compounds, of yttrium, lanthanum, cerium and/or hafnium, each calculated as $Y_2O_3$, $La_2O_3$, $Ce_2O_3$ and $Hf_2O_3$, respectively. Another suitable catalyst is a zirconium, copper, and nickel catalyst, where the catalytically active composition comprises from about 20 to about 85% by weight of oxygen-containing zirconium compounds, calculated as $ZrO_2$, from about 1 to about 30% by weight of oxygen-containing compounds of copper, calculated as CuO, from about 30 to about 70% by weight of oxygen-containing compounds of nickel, calculated as NiO, from about 0.1 to about 5% by weight of oxygen-containing compounds of aluminium and/or manganese, calculated as $Al_2O_3$ and $MnO_2$ respectively.

For the reductive amination step, a supported as well as non-supported catalyst may be used. The supported catalyst is obtained, for example, by deposition of the metallic components of the catalyst compositions onto support materials known to those skilled in the art, using techniques which are well-known in the art, including without limitation, known forms of alumina, silica, charcoal, carbon, graphite, clays, mordenites; and molecular sieves, to provide supported catalysts as well. When the catalyst is supported, the support particles of the catalyst may have any geometric shape, for example spheres, tablets, or cylinders, in a regular or irregular version. The process may be carried out in a continuous or discontinuous mode, e.g. in an autoclave, tube reactor, or fixed-bed reactor. The feed thereto may be upflowing or downflowing, and design features in the reactor which optimize plug flow in the reactor may be employed. The degree of amination is from about 50% to about 100%, typically from about 60% to about 100%, and more typically from about 70% to about 100%.

The degree of amination is calculated from the total amine value (AZ) divided by sum of the total acetylables value (AC) and tertiary amine value (tert. AZ) multiplied by 100: (Total AZ: (AC+tert. AZ))×100). The total amine value (AZ) is determined according to DIN 16945. The total acetylables value (AC) is determined according to DIN 53240. The secondary and tertiary amines are determined according to ASTM D2074-07.

The hydroxyl value is calculated from (total acetylables value+tertiary amine value)−total amine value. The polyetheramines of the invention are effective for removal of greasy soils, in particular removal of crystalline grease.

Especially preferred for use herein is a polyethylene amine of Formula (I) having the following structure formula:

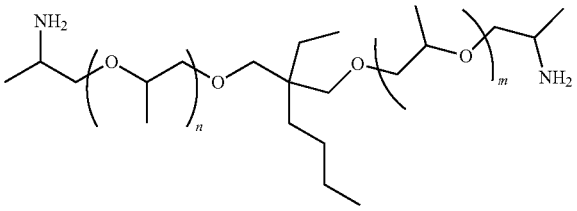

wherein n+m is from 0 to 8. Preferably n+m is from 0 to 6 and more preferably from 1 to 6.

The polyetheramine may be a polyetheramine of Formula (III),

Formula (III)

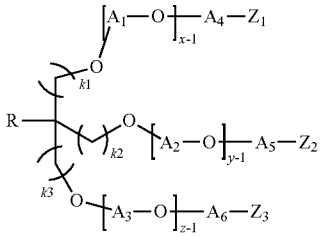

wherein

R is selected from H or a C1-C6 alkyl group, each of $k_1$, $k_2$, and $k_3$ is independently selected from 0, 1, 2, 3, 4, 5, or 6, each of $A_1$, $A_2$, $A_3$, $A_4$, $A_5$, and $A_6$ is independently selected from a linear or branched alkylene group having from about 2 to about 18 carbon atoms or mixtures thereof, x≥1, y≥1, and z≥1, and the sum of x+y+z is in the range of from about 3 to about 100, and each of $Z_1$, $Z_2$, and $Z_3$ is independently selected from $NH_2$ or OH, where at least two of $Z_1$, $Z_2$, and $Z_3$ are $NH_2$.

Preferably, R is H or a C1-C6 alkyl group selected from methyl, ethyl, or propyl. In some aspects, R is H or a C1-C6 alkyl group selected from ethyl.

Preferably, each of $k_1$, $k_2$, and $k_3$ is independently selected from 0, 1, or 2. Each of $k_1$, $k_2$, and $k_3$ may be independently selected from 0 or 1. More preferably, at least two of $k_1$, $k_2$, and $k_3$ are 1 and even more preferably, each of $k_1$, $k_2$, and $k_3$ is 1.

Preferably, each of $Z_1$, $Z_2$, and $Z_3$ is $NH_2$.

All A groups (i.e., $A_1$-$A_6$) may be the same, at least two A groups may be the same, at least two A groups may be different, or all A groups may be different from each other. Each of $A_1$, $A_2$, $A_3$, $A_4$, $A_5$, and $A_6$ may be independently selected from a linear or branched alkylene group having from about 2 to about 10 carbon atoms, or from about 2 to about 6 carbon atoms, or from about 2 to about 4 carbon atoms, or mixtures thereof. Preferably, at least one, or at least three, of $A_1$-$A_6$ is a linear or branched butylene group. More preferably, each of $A_4$, $A_5$, and $A_6$ is a linear or branched butylene group. Especially, each of $A_1$-$A_6$ is a linear or branched butylene group. Preferably, x, y, and/or z are independently selected and should be equal to 3 or greater, meaning that that the polyetheramine may have more than one [$A_1$-O] group, more than one [$A_2$-O] group, and/or more than one [$A_3$-O] group. Preferably, $A_1$ is selected from ethylene, propylene, butylene, or mixtures thereof. Preferably, $A_2$ is selected from ethylene, propylene, butylene, or mixtures thereof. Preferably, $A_3$ is selected from ethylene, propylene, butylene, or mixtures thereof. When $A_1$, $A_2$, and/or $A_3$ are mixtures of ethylene, propylene, and/or butylenes, the resulting alkoxylate may have a block-wise structure or a random structure.

$[A_1\text{-}O]_{x\text{-}1}$ can be selected from ethylene oxide, propylene oxide, butylene oxide, or mixtures thereof. $[A_2\text{-}O]_{y\text{-}1}$ can be selected from ethylene oxide, propylene oxide, butylene oxide, or mixtures thereof. $[A_3\text{-}O]_{z\text{-}1}$ can be selected from ethylene oxide, propylene oxide, butylene oxide, or mixtures thereof.

Preferably, the sum of x+y+z is in the range of from about 3 to about 100, or from about 3 to about 30, or from about 3 to about 10, or from about 5 to about 10.

Typically, the polyetheramines of the present invention have a weight average molecular weight of from about 150, or from about 200, or from about 350, or from about 500 grams/mole, to about 1000, or to about 900, or to about 800 grams/mole.

Preferably, when the polyetheramine is a polyetheramine of Formula (III) where R is a C2 alkyl group (i.e., ethyl) and optionally each of $k_1$, $k_2$, and $k_3$ is 1, the molecular weight of the polyetheramine is from about 500 to about 1000, or to about 900, or to about 800 grams/mole. It is also preferred, when the polyetheramine is a polyetheramine of Formula (III) where R is a C2 alkyl group (i.e., ethyl) and optionally each of $k_1$, $k_2$, and $k_3$ is 1, at least one A group (i.e., at least one of A1, A2, A3, A4, A5, or A6) is not a propylene group. It is also preferred, when the polyetheramine is a polyetheramine of Formula (III) where R is a C2 alkyl group (i.e., ethyl) and optionally each of $k_1$, $k_2$, and $k_3$ is 1, at least one A group (i.e., at least one of A1, A2, A3, A4, A5, or A6) is a ethylene group or a butylene group, or more typically at least one A group (i.e., at least one of A1, A2, A3, A4, A5, or A6) is a butylene group.

Polyetheramine with the following structure are preferred for use herein:

Formula C

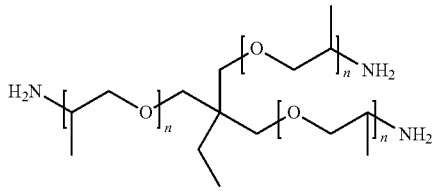

where average n is from about 0.5 to about 5, or from about 1 to about 3, or from about 1 to about 2.5.

Other preferred polyetheramines are selected from the group consisting of Formula C, Formula D, Formula E, and mixtures thereof:

Formula D

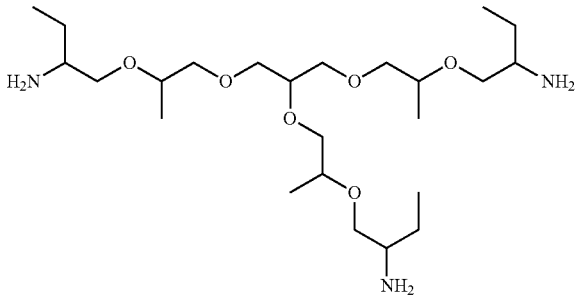

Formula E

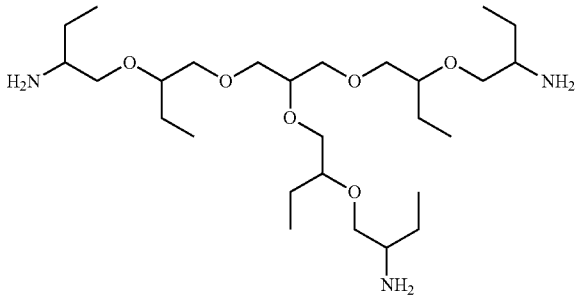

Formula C

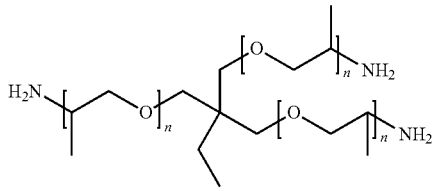

where average n is from about 0.5 to about 5.

The polyetheramines of Formula (III) of the present invention may be obtained by a process comprising the following steps:

a) reacting a low-molecular-weight, organic triol, such as glycerine and/or 1,1,1-trimethylolpropane, with $C_2$-$C_{18}$ alkylene oxide, to form an alkoxylated triol, where the molar ratio of the low-molecular-weight organic triol to the alkylene oxide is in the range of about 1:3 to about 1:10, and b) aminating the alkoxylated triol with ammonia.

This process is described in more detail below.

Alkoxylation

Polyetheramines according to Formula (III) may be obtained by reductive amination of an alkoxylated triol.

Alkoxylated triols according to the present disclosure may be obtained by reaction of low-molecular-weight, organic triols, such as glycerine and/or 1,1,1-trimethylolpropane, with alkylene oxides according to general alkoxylation procedures known in the art.

By "low-molecular-weight," it is meant that the triol has a molecular weight of from about 64 to about 500, or from about 64 to about 300, or from about 78 to about 200, or from about 92 to about 135 g/mol. The triol may be water soluble.

A low-molecular-weight, organic triol useful herein (or simply "low-molecular-weight triol," as used herein) has the structure of Formula (4):

Formula (4)

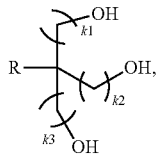

where R is selected from H or a C1-C6 alkyl group, and where each k is independently selected from 0, 1, 2, 3, 4, 5, or 6. Preferably, R is H or a C1-C6 alkyl group selected from methyl, ethyl, or propyl. More preferably, R is H or ethyl. $k_1$, $k_2$, and $k_3$ can each be independently selected from 0, 1, or 2. Each of $k_1$, $k_2$, and $k_3$ may be independently selected from 0 or 1. Preferably, at least two of $k_1$, $k_2$, and $k_3$ are 1. More preferably, all three of $k_1$, $k_2$, and $k_3$ are 1.

The low-molecular-weight triol can be selected from glycerine, 1,1,1-trimethylolpropane, or mixtures thereof.

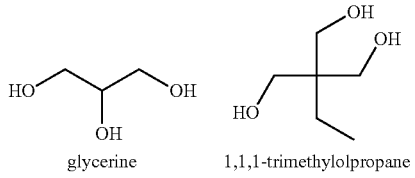

The alkoxylated triol, such as alkoxylated glycerine or alkoxylated 1,1,1-trimethylolpropane, may be prepared in a known manner by reaction of the low-molecular-weight triol with an alkylene oxide. Suitable alkylene oxides are linear or branched $C_2$-$C_{18}$ alkylene oxides, typically $C_2$-$C_{10}$ alkylene oxides, more typically $C_2$-$C_6$ alkylene oxides or $C_2$-$C_4$ alkylene oxides. Suitable alkylene oxides include ethylene oxide, propylene oxide, butylene oxide, pentene oxide, hexene oxide, decene oxide, and dodecene oxide. In some aspects, the $C_2$-$C_{18}$ alkylene oxide is selected from ethylene oxide, propylene oxide, butylene oxide, or a mixture thereof. In some aspects, the $C_2$-$C_{18}$ alkylene oxide is butylene oxide, optionally in combination with other $C_2$-$C_{18}$ alkylene oxides.

The low molecular weight triols, such as glycerine or 1,1,1-trimethylolpropane, may be reacted with one single type of alkylene oxide or combinations of two or more different types of alkylene oxides, e.g., ethylene oxide and propylene oxide. If two or more different types of alkylene oxides are used, the resulting alkoxylate may have a blockwise structure or a random structure. Typically, the molar ratio of low-molecular-weight triol to $C_2$-$C_{18}$ alkylene oxide at which the alkoxylation reaction is carried out is in the range of about 1:3 to about 1:10, more typically about 1:3 to about 1:6, even more typically about 1:4 to about 1:6. In some aspects, the molar ratio of low-molecular-weight triol to $C_2$-$C_{18}$ alkylene oxide at which the alkoxylation reaction is carried out is in the range of about 1:5 to about 1:10.

When the low-molecular-weight triol is 1,1,1-trimethylolpropane, or when R of the triol of Formula (2) is a C2 alkyl and each of $k_1$, $k_2$, and $k_3$ are 1, the polyetheramine has a weight average molecular weight of from about 500 to about 1000, or to about 900, or to about 800 grams/mole.

The reaction is generally performed in the presence of a catalyst in an aqueous solution at a reaction temperature of from about 70° C. to about 200° C., and typically from about 80° C. to about 160° C. This reaction may be performed at a pressure of up to about 10 bar, or up to about 8 bar. Examples of suitable catalysts are basic catalysts such as alkali metal and alkaline earth metal hydroxides, such as sodium hydroxide, potassium hydroxide and calcium hydroxide, alkali metal alkoxides, in particular sodium and potassium $C_1$-$C_4$-alkoxides, such as sodium methoxide, sodium ethoxide and potassium tert-butoxide, alkali metal and alkaline earth metal hydrides, such as sodium hydride and calcium hydride, and alkali metal carbonates, such as sodium carbonate and potassium carbonate. Alkali metal hydroxides, such as potassium hydroxide and sodium hydroxide, are particularly suitable. Typical use amounts for the basic catalyst are from about 0.05 to about 10% by weight, in particular from about 0.1 to about 2% by weight, based on the total amount of the low-molecular-weight triol and the alkylene oxide.

Amination

Polyetheramines according to Formula (III) may be obtained by reductive amination of an alkoxylated triol, such as those described above, for example alkoxylated glycerine or alkoxylated 1,1,1-trimethylolpropane, with ammonia in the presence of hydrogen and a catalyst, such as a catalyst containing nickel. Suitable catalysts are described in WO 2011/067199 A1, in WO2011/067200 A1, and in EP0696572 B1.

The amination may be carried out in the presence of copper-, nickel- or cobalt-containing catalyst. Preferred catalysts are supported copper-, nickel- and cobalt-containing catalysts, wherein the catalytically active material of the catalysts, before the reduction thereof with hydrogen, comprises oxygen compounds of aluminium, copper, nickel and cobalt, and, in the range of from about 0.2% to about 5.0% by weight, of oxygen compounds of tin, calculated as SnO. Other preferred catalysts are supported copper-, nickel- and cobalt-containing catalysts, wherein the catalytically active material of the catalysts, before the reduction thereof with hydrogen, comprises oxygen compounds of aluminium, copper, nickel, cobalt, tin, and, in the range of from about 0.2 to about 5.0% by weight, of oxygen compounds of yttrium, lanthanum, cerium and/or hafnium, each calculated as $Y_2O_3$, $La_2O_3$, $Ce_2O_3$ and $Hf_2O_3$, respectively. Another suitable catalyst is a zirconium, copper, nickel catalyst, wherein the catalytically active composition comprises from about 20 to about 85% by weight of oxygen-containing zirconium compounds, calculated as $ZrO_2$, from about 1 to about 30% by weight of oxygen-containing compounds of copper, calculated as CuO, from about 30 to about 70% by weight of oxygen-containing compounds of nickel, calculated as NiO, from about 0.1 to about 5% by weight of oxygen-containing compounds of aluminium and/or manganese, calculated as $Al_2O_3$ and $MnO_2$, respectively.

For the reductive amination step, a supported as well as a non-supported catalyst can be used. The supported catalyst may be obtained by deposition of the metallic components of the catalyst compositions onto support materials known to those skilled in the art, using techniques that are well-known in the art, including, without limitation, known forms of alumina, silica, charcoal, carbon, graphite, clays, mordenites; molecular sieves may be used to provide supported catalysts as well. When the catalyst is supported, the support particles of the catalyst may have any geometric shape, for example, the shape of spheres, tablets, or cylinders in a regular or irregular version.

The process can be carried out in a continuous or discontinuous mode, e.g., in an autoclave, tube reactor, or fixed-bed reactor. A number of reactor designs may be used. For example, the feed thereto may be upflowing or downflowing, and design features in the reactor that optimize plug flow in the reactor may be employed.

The degree of amination may be from about 67% to about 100%, or from about 85% to about 100%. The degree of amination is calculated from the total amine value (AZ) divided by sum of the total acetylables value (AC) and tertiary amine value (tert. AZ) multiplied by 100 (Total AZ/((AC+tert. AZ)×100)).

The total amine value (AZ) is determined according to DIN 16945.

The total acetylables value (AC) is determined according to DIN 53240.

The secondary and tertiary amines are determined according to ASTM D2074-07.

The hydroxyl value is calculated from (total acetylables value+tertiary amine value)−total amine value.

The term "amine" herein encompasses a single amine and a mixture thereof.

The amine can be subjected to protonation depending on the pH of the cleaning medium in which it is used. The use of quaternized amines is envisaged in the present invention although it is not preferred.

Surfactant System

The cleaning composition comprises from about 1% to about 60%, preferably from about 5% to about 50% more preferably from about 8% to about 40% by weight thereof of a surfactant system. The surfactant system comprises an anionic surfactant, more preferably an anionic surfactant selected from the group consisting of alkyl sulfate, alkyl alkoxy surfate, especially alkyl ethoxy sulfate, alkyl benzene sulfonate, paraffin sulfonate and mixtures thereof. The system also comprises an amphoteric, and/or zwitterionic surfactant and optionally a non-ionic surfactant.

Alkyl sulfates are preferred for use herein and also alkyl ethoxy sulfates; more preferably a combination of alkyl sulfates and alkyl ethoxy sulfates with a combined average ethoxylation degree of less than 5, preferably less than 3, more preferably less than 2 and more than 0.5 and an average level of branching of from about 5% to about 40%.

The composition of the invention comprises amphoteric and/or zwitterionic surfactant, preferably the amphoteric surfactant comprises an amine oxide, preferably an alkyl dimethyl amine oxide, and the zwitteronic surfactant comprises a betaine surfactant.

The most preferred surfactant system for the detergent composition of the present invention comprise from 1% to 40%, preferably 6% to 35%, more preferably 8% to 30% weight of the total composition of an anionic surfactant, preferably an alkyl alkoxy sulfate surfactant, more preferably an alkyl ethoxy sulfate, combined with 0.5% to 15%, preferably from 1% to 12%, more preferably from 2% to 10% by weight of the composition of amphoteric and/or zwitterionic surfactant, more preferably an amphoteric and even more preferably an amine oxide surfactant, especially and alkyl dimethyl amine oxide. Preferably the composition further comprises a nonionic surfactant, especially an alcohol alkoxylate in particular and alcohol ethoxylate nonionic surfactant. It has been found that such surfactant system in combination with the polyetheramine of the invention provides excellent grease cleaning and good finish of the washed items.

Anionic Surfactant

Anionic surfactants include, but are not limited to, those surface-active compounds that contain an organic hydrophobic group containing generally 8 to 22 carbon atoms or generally 8 to 18 carbon atoms in their molecular structure and at least one water-solubilizing group preferably selected from sulfonate, sulfate, and carboxylate so as to form a water-soluble compound. Usually, the hydrophobic group will comprise a C8-C22 alkyl, or acyl group. Such surfactants are employed in the form of water-soluble salts and the salt-forming cation usually is selected from sodium, potassium, ammonium, magnesium and mono-, di- or tri-C2-C3 alkanolammonium, with the sodium, cation being the usual one chosen.

The anionic surfactant can be a single surfactant but usually it is a mixture of anionic surfactants. Preferably the anionic surfactant comprises a sulfate surfactant, more preferably a sulfate surfactant selected from the group consisting of alkyl sulfate, alkyl alkoxy sulfate and mixtures thereof. Preferred alkyl alkoxy sulfates for use herein are alkyl ethoxy sulfates.

Sulfated Anionic Surfactant

Preferably the sulfated anionic surfactant is alkoxylated, more preferably, an alkoxylated branched sulfated anionic surfactant having an alkoxylation degree of from about 0.2 to about 4, even more preferably from about 0.3 to about 3, even more preferably from about 0.4 to about 1.5 and especially from about 0.4 to about 1. Preferably, the alkoxy group is ethoxy. When the sulfated anionic surfactant is a mixture of sulfated anionic surfactants, the alkoxylation degree is the weight average alkoxylation degree of all the components of the mixture (weight average alkoxylation degree). In the weight average alkoxylation degree calculation the weight of sulfated anionic surfactant components not having alkoxylated groups should also be included.

$$\text{Weight average alkoxylation degree} = (x1 * \text{alkoxylation degree of surfactant } 1 + x2 * \text{alkoxylation degree of surfactant } 2 + \ldots)/(x1 + x2 + \ldots)$$

wherein x1, x2, . . . are the weights in grams of each sulfated anionic surfactant of the mixture and alkoxylation degree is the number of alkoxy groups in each sulfated anionic surfactant.

Preferably, the branching group is an alkyl. Typically, the alkyl is selected from methyl, ethyl, propyl, butyl, pentyl, cyclic alkyl groups and mixtures thereof. Single or multiple alkyl branches could be present on the main hydrocarbyl chain of the starting alcohol(s) used to produce the sulfated anionic surfactant used in the detergent of the invention. Most preferably the branched sulfated anionic surfactant is selected from alkyl sulfates, alkyl ethoxy sulfates, and mixtures thereof.

The branched sulfated anionic surfactant can be a single anionic surfactant or a mixture of anionic surfactants. In the case of a single surfactant the percentage of branching refers to the weight percentage of the hydrocarbyl chains that are branched in the original alcohol from which the surfactant is derived.

In the case of a surfactant mixture the percentage of branching is the weight average and it is defined according to the following formula:

$$\text{Weight average of branching (\%)}=[(x1*\text{wt \% branched alcohol 1 in alcohol 1}+x2*\text{wt \% branched alcohol 2 in alcohol 2}+\ldots)/(x1+x2+\ldots)]*100$$

wherein x1, x2, . . . are the weight in grams of each alcohol in the total alcohol mixture of the alcohols which were used as starting material for the anionic surfactant for the detergent of the invention. In the weight average branching degree calculation the weight of anionic surfactant components not having branched groups should also be included.

Suitable sulfate surfactants for use herein include water-soluble salts of C8-C18 alkyl or hydroxyalkyl, sulfate and/or ether sulfate. Suitable counterions include alkali metal cation or ammonium or substituted ammonium, but preferably sodium.

The sulfate surfactants may be selected from C8-C18 primary, branched chain and random alkyl sulfates (AS); C8-C18 secondary (2,3)alkyl sulfates; C8-C18 alkyl alkoxy sulfates (AExS) wherein preferably x is from 1-30 in which the alkoxy group could be selected from ethoxy, propoxy, butoxy or even higher alkoxy groups and mixtures thereof.

Alkyl sulfates and alkyl alkoxy sulfates are commercially available with a variety of chain lengths, ethoxylation and branching degrees. Commercially available sulfates include, those based on Neodol alcohols ex the Shell company, Lial-Isalchem and Safol ex the Sasol company, natural alcohols ex The Procter & Gamble Chemicals company.

Preferably, the anionic surfactant comprises at least 50%, more preferably at least 60% and especially at least 70% of a sulfate surfactant by weight of the anionic surfactant. Especially preferred detergents from a cleaning view point are those in which the anionic surfactant comprises more than 50%, more preferably at least 60% and especially at least 70% by weight thereof of sulfate surfactant and the sulfate surfactant is selected from the group consisting of alkyl sulfates, alkyl ethoxy sulfates and mixtures thereof. Even more preferred are those in which the anionic surfactant is an alkyl ethoxy sulfate with a degree of ethoxylation of from about 0.2 to about 3, more preferably from about 0.3 to about 2, even more preferably from about 0.4 to about 1.5, and especially from about 0.4 to about 1. They are also preferred anionic surfactant having a level of branching of from about 5% to about 40%, even more preferably from about 10% to 35% and especially from about 20% to 30%.

Sulphonate Surfactant

Suitable sulphonate surfactants for use herein include water-soluble salts of C8-C18 alkyl or hydroxyalkyl sulphonates; C11-C18 alkyl benzene sulphonates (LAS), modified alkylbenzene sulphonate (MLAS) as discussed in WO 99/05243, WO 99/05242, WO 99/05244, WO 99/05082, WO 99/05084, WO 99/05241, WO 99/07656, WO 00/23549, and WO 00/23548; methyl ester sulphonate (MES); and alpha-olefin sulphonate (AOS). Those also include the paraffin sulphonates may be monosulphonates and/or disulphonates, obtained by sulphonating paraffins of 10 to 20 carbon atoms. The sulfonate surfactant also include the alkyl glyceryl sulphonate surfactants.

Non Ionic Surfactant

Nonionic surfactant, when present, is comprised in a typical amount of from 0.1% to 40%, preferably 0.2% to 20%, most preferably 0.5% to 10% by weight of the composition. Suitable nonionic surfactants include the condensation products of aliphatic alcohols with from 1 to 25 moles of ethylene oxide. The alkyl chain of the aliphatic alcohol can either be straight or branched, primary or secondary, and generally contains from 8 to 22 carbon atoms. Particularly preferred are the condensation products of alcohols having an alkyl group containing from 10 to 18 carbon atoms, preferably from 10 to 15 carbon atoms with from 2 to 18 moles, preferably 2 to 15, more preferably 5-12 of ethylene oxide per mole of alcohol. Highly preferred nonionic surfactants are the condensation products of guerbet alcohols with from 2 to 18 moles, preferably 2 to 15, more preferably 5-12 of ethylene oxide per mole of alcohol.

Other suitable non-ionic surfactants for use herein include fatty alcohol polyglycol ethers, alkylpolyglucosides and fatty acid glucamides.

Amphoteric Surfactant

Preferred amine oxides are alkyl dimethyl amine oxide or alkyl amido propyl dimethyl amine oxide, more preferably alkyl dimethyl amine oxide and especially coco dimethyl amino oxide. Amine oxide may have a linear or mid-branched alkyl moiety. Typical linear amine oxides include water-soluble amine oxides containing one R1 C8-18 alkyl moiety and 2 R2 and R3 moieties selected from the group consisting of C1-3 alkyl groups and C1-3 hydroxyalkyl groups. Preferably amine oxide is characterized by the formula R1-N(R2)(R3)O wherein R1 is a C8-18 alkyl and R2 and R3 are selected from the group consisting of methyl, ethyl, propyl, isopropyl, 2-hydroxethyl, 2-hydroxypropyl and 3-hydroxypropyl. The linear amine oxide surfactants in particular may include linear C10-C18 alkyl dimethyl amine oxides and linear C8-C12 alkoxy ethyl dihydroxy ethyl amine oxides. Preferred amine oxides include linear C10, linear C10-C12, and linear C12-C14 alkyl dimethyl amine oxides. As used herein "mid-branched" means that the amine oxide has one alkyl moiety having n1 carbon atoms with one alkyl branch on the alkyl moiety having n2 carbon atoms. The alkyl branch is located on the a carbon from the nitrogen on the alkyl moiety. This type of branching for the amine oxide is also known in the art as an internal amine oxide. The total sum of n1 and n2 is from 10 to 24 carbon atoms, preferably from 12 to 20, and more preferably from 10 to 16. The number of carbon atoms for the one alkyl moiety (n1) should be approximately the same number of carbon atoms as the one alkyl branch (n2) such that the one alkyl moiety and the one alkyl branch are symmetric. As used herein "symmetric" means that $|n1-n2|$ is less than or equal to 5, preferably 4, most preferably from 0 to 4 carbon atoms in at least 50 wt %, more preferably at least 75 wt % to 100 wt % of the mid-branched amine oxides for use herein.

The amine oxide further comprises two moieties, independently selected from a C1-3 alkyl, a C1-3 hydroxyalkyl group, or a polyethylene oxide group containing an average of from about 1 to about 3 ethylene oxide groups. Preferably the two moieties are selected from a C1-3 alkyl, more preferably both are selected as a C1 alkyl.

Zwitterionic Surfactant

Other suitable surfactants include betaines, such as alkyl betaines, alkylamidobetaine, amidazoliniumbetaine, sulfobetaine (INCI Sultaines) as well as the Phosphobetaine and preferably meets formula (I):

$$R^1—[CO—X(CH_2)_n]_x—N^+(R^2)(R^3)—(CH_2)_m—[CH(OH)—CH_2]_y—Y— \quad (I)$$

wherein $R^1$ is a saturated or unsaturated C6-22 alkyl residue, preferably C8-18 alkyl residue, in particular a saturated C10-16 alkyl residue, for example a saturated C12-14 alkyl residue;

X is NH, $NR^4$ with C1-4 Alkyl residue $R^4$, O or S, n a number from 1 to 10, preferably 2 to 5, in particular 3, x 0 or 1, preferably 1, $R^2$, $R^3$ are independently a C1-4 alkyl residue, potentially hydroxy substituted such as a hydroxyethyl, preferably a methyl.

m a number from 1 to 4, in particular 1, 2 or 3, y 0 or 1 and

Y is COO, SO3, $OPO(OR^5)O$ or $P(O)(OR^5)O$, whereby $R^5$ is a hydrogen atom H or a C1-4 alkyl residue.

Preferred betaines are the alkyl betaines of the formula (Ia), the alkyl amido propyl betaine of the formula (Ib), the Sulfo betaines of the formula (Ic) and the Amido sulfobetaine of the formula (Id);

$$R^1—N^+(CH_3)_2—CH_2COO^- \quad (Ia)$$

$$R^1—CO—NH(CH_2)_3—N^+(CH_3)_2—CH_2COO^- \quad (Ib)$$

$$R^1—N^+(CH_3)_2—CH_2CH(OH)CH_2SO_3— \quad (Ic)$$

$$R^1—CO—NH—(CH_2)_3—N^+(CH_3)_2—CH_2CH(OH)CH_2SO_3— \quad (Id)$$

in which $R^1$ 1 as the same meaning as in formula I. Particularly preferred betaines are the Carbobetaine [wherein $Y^-$=$COO^-$], in particular the Carbobetaine of the formula (Ia) and (Ib), more preferred are the Alkylamidobetaine of the formula (Ib).

Examples of suitable betaines and sulfobetaine are the following [designated in accordance with INCI]: Almondamidopropyl of betaines, Apricotam idopropyl betaines, Avocadamidopropyl of betaines, Babassuamidopropyl of betaines, Behenam idopropyl betaines, Behenyl of betaines, betaines, Canolam idopropyl betaines, Capryl/Capram idopropyl betaines, Carnitine, Cetyl of betaines, Cocamidoethyl of betaines, Cocam idopropyl betaines, Cocam idopropyl Hydroxysultaine, Coco betaines, Coco Hydroxysultaine, Coco/Oleam idopropyl betaines, Coco Sultaine, Decyl of betaines, Dihydroxyethyl Oleyl Glycinate, Dihydroxyethyl Soy Glycinate, Dihydroxyethyl Stearyl Glycinate, Dihydroxyethyl Tallow Glycinate, Dimethicone Propyl of PG-betaines, Erucam idopropyl Hydroxysultaine, Hydrogenated Tallow of betaines, Isostearam idopropyl betaines, Lauram idopropyl betaines, Lauryl of betaines, Lauryl Hydroxysultaine, Lauryl Sultaine, Milkam idopropyl betaines, Minkamidopropyl of betaines, Myristam idopropyl betaines, Myristyl of betaines, Oleam idopropyl betaines, Oleam idopropyl Hydroxysultaine, Oleyl of betaines, Olivamidopropyl of betaines, Palmam idopropyl betaines, Palm itam idopropyl betaines, Palmitoyl Carnitine, Palm Kernelam idopropyl betaines, Polytetrafluoroethylene Acetoxypropyl of betaines, Ricinoleam idopropyl betaines, Sesam idopropyl betaines, Soyam idopropyl betaines, Stearam idopropyl betaines, Stearyl of betaines, Tallowam idopropyl betaines, Tallowam idopropyl Hydroxysultaine, Tallow of betaines, Tallow Dihydroxyethyl of betaines, Undecylenam idopropyl betaines and Wheat Germam idopropyl betaines.

A preferred betaine is, for example, Cocoamidopropylbetain.

Divalent Cation

When utilized in the composition of the invention, divalent cations such as calcium and magnesium ions, preferably magnesium ions, are preferably added as a hydroxide, chloride, acetate, sulfate, formate, oxide, lactate or nitrate salt to the compositions of the present invention, typically at an active level of from 0.01% to 1.5%, preferably from 0.015% to 1%, more preferably from 0.025% to 0.5%, by weight of the composition.

Chelant

The composition herein may optionally further comprise a chelant at a level of from 0.1% to 20%, preferably from 0.2% to 5%, more preferably from 0.2% to 3% by weight of the composition.

As commonly understood in the detergent field, chelation herein means the binding or complexation of a bi- or multi-dentate ligand. These ligands, which are often organic compounds, are called chelants, chelators, chelating agents, and/or sequestering agent. Chelating agents form multiple bonds with a single metal ion. Chelants, are chemicals that form soluble, complex molecules with certain metal ions, inactivating the ions so that they cannot normally react with other elements or ions to produce precipitates or scale, or destabilizing soils facilitating their removal accordingly. The ligand forms a chelate complex with the substrate. The term is reserved for complexes in which the metal ion is bound to two or more atoms of the chelant.

Suitable chelating agents can be selected from the group consisting of amino carboxylates, amino phosphonates, polyfunctionally-substituted aromatic chelating agents and mixtures thereof.

Amino carboxylates include ethylenediaminetetra-acetates, N-hydroxyethylethylenediaminetriacetates, nitrilotriacetates, ethylenediamine tetraproprionates, triethylenetetraaminehexacetates, diethylenetriaminepentaacetates, and ethanoldiglycines, alkali metal, ammonium, and substituted ammonium salts therein and mixtures therein, as well as MGDA (methyl-glycine-diacetic acid), and salts and derivatives thereof and GLDA (glutamic-N,N-diacetic acid) and salts and derivatives thereof. GLDA (salts and derivatives thereof) is especially preferred according to the invention, with the tetrasodium salt thereof being especially preferred.

Other suitable chelants include amino acid based compound or a succinate based compound. The term "succinate based compound" and "succinic acid based compound" are used interchangeably herein. Other suitable chelants are described in U.S. Pat. No. 6,426,229. Particular suitable chelants include; for example, aspartic acid-N-monoacetic acid (ASMA), aspartic acid-N,N-diacetic acid (ASDA), aspartic acid-N-monopropionic acid (ASMP), iminodisuccinic acid (IDS), Imino diacetic acid (IDA), N-(2-sulfomethyl) aspartic acid (SMAS), N-(2-sulfoethyl) aspartic acid (SEAS), N-(2-sulfomethyl) glutamic acid (SMGL), N-(2-sulfoethyl) glutamic acid (SEGL), N-methyliminodiacetic acid (MIDA), alanine-N,N-diacetic acid (ALDA), serine-N, N-diacetic acid (SEDA), isoserine-N,N-diacetic acid (ISDA), phenylalanine-N,N-diacetic acid (PHDA), anthranilic acid-N,N-diacetic acid (ANDA), sulfanilic acid-N, N-diacetic acid (SLDA), taurine-N, N-diacetic acid (TUDA) and sulfomethyl-N,N-diacetic acid (SMDA) and alkali metal salts or ammonium salts thereof. Also suitable is ethylenediamine disuccinate ("EDDS"), especially the [S,S] isomer as described in U.S. Pat. No. 4,704,233. Furthermore, Hydroxyethyleneiminodiacetic acid, Hydroxyiminodisuccinic acid, Hydroxyethylene diaminetriacetic acid are also suitable.

Other chelants include homopolymers and copolymers of polycarboxylic acids and their partially or completely neutralized salts, monomeric polycarboxylic acids and hydroxycarboxylic acids and their salts. Preferred salts of the abovementioned compounds are the ammonium and/or alkali metal salts, i.e. the lithium, sodium, and potassium salts, and particularly preferred salts are the sodium salts.

Suitable polycarboxylic acids are acyclic, alicyclic, heterocyclic and aromatic carboxylic acids, in which case they contain at least two carboxyl groups which are in each case separated from one another by, preferably, no more than two carbon atoms. Polycarboxylates which comprise two carboxyl groups include, for example, water-soluble salts of, malonic acid, (ethylenedioxy)diacetic acid, maleic acid, diglycolic acid, tartaric acid, tartronic acid and fumaric acid. Polycarboxylates which contain three carboxyl groups include, for example, water-soluble citrate. Correspondingly, a suitable hydroxycarboxylic acid is, for example, citric acid. Another suitable polycarboxylic acid is the homopolymer of acrylic acid. Preferred are the polycarboxylates end capped with sulfonates.

Amino phosphonates are also suitable for use as chelating agents and include ethylenediaminetetrakis (methylenephosphonates) as DEQUEST. Preferred are these amino phosphonates that do not contain alkyl or alkenyl groups with more than about 6 carbon atoms. Polyfunctionally-substituted aromatic chelating agents are also useful in the compositions herein such as described in U.S. Pat. No. 3,812,044. Preferred compounds of this type are dihydroxydisulfobenzenes such as 1,2-dihydroxy-3,5-disulfobenzene.

Further suitable polycarboxylates chelants for use herein include citric acid, lactic acid, acetic acid, succinic acid, formic acid; all preferably in the form of a water-soluble salt. Other suitable polycarboxylates are oxodisuccinates, carboxymethyloxysuccinate and mixtures of tartrate monosuccinic and tartrate disuccinic acid such as described in U.S. Pat. No. 4,663,071.

The most preferred carboxylates for use in the present invention are selected from the group consisting of MGDA, GLDA, citrate and mixtures thereof.

Preservatives

The composition of the invention preferably comprises a preservative. A preservative is a naturally occurring or synthetically produced substance that is added to detergent compositions to prevent decomposition by microbial growth or by undesirable chemical changes. Preservatives can be divided into two types, depending on their origin. Class I preservatives refers to those preservatives which are naturally occurring, everyday substances. Class II preservatives refer to preservatives which are synthetically manufactured. Most preferred preservatives for use in liquid detergent compositions include derivatives of isothiazolinones, including methylisothiazolinone, methylchloroisothiazolinone, octylisothiazolinone, 1,2-benzisothiazolinone, and mixtures thereof. Other non-limiting examples of preservatives typically used are phenoxyethanol, paraben derivatives such as methyl paraben and propyl paraben, imidazole derivatives, and aldehydes including glutaraldehyde.

The detergent composition herein may comprise a number of optional ingredients such as builders, conditioning polymers, cleaning polymers, surface modifying polymers, soil flocculating polymers, structurants, emollients, humectants, skin rejuvenating actives, enzymes, carboxylic acids, scrubbing particles, bleach and bleach activators, perfumes, malodor control agents, pigments, dyes, opacifiers, beads, pearlescent particles, microcapsules, antibacterial agents, enzymes and pH adjusters and buffering means or water or any other dilutents or solvents compatible with the formulation.

Method of Washing

The second aspect of the invention is directed to methods of washing dishware with the composition of the present invention. Said method comprises the step of applying the composition, preferably in liquid form, onto the dishware surface, either in diluted or neat form and rinsing or leaving the composition to dry on the surface without rinsing the surface.

By "in its neat form", it is meant herein that said composition is not diluted in a full sink of water. The composition is applied directly onto the surface to be treated and/or onto a cleaning device or implement such as a dish cloth, a sponge or a dish brush without undergoing major dilution (immediately) prior to the application. The cleaning device or implement is preferably wet before or after the composition is delivered to it. Especially good grease removal has been found when the composition is used in neat form. By "diluted form", it is meant herein that said composition is diluted by the user with an appropriate solvent, typically water. By "rinsing", it is meant herein contacting the dishware cleaned using a process according to the present invention with substantial quantities of appropriate solvent, typically water, after the step of applying the liquid composition herein onto said dishware. By "substantial quantities", it is meant usually about 1 to about 10 liters.

The composition herein can be applied in its diluted form. Soiled dishes are contacted with an effective amount, typically from about 0.5 ml to about 20 ml (per about 25 dishes being treated), preferably from about 3 ml to about 10 ml, of the detergent composition, preferably in liquid form, of the present invention diluted in water. The actual amount of detergent composition used will be based on the judgment of user, and will typically depend upon factors such as the particular product formulation of the composition, including the concentration of active ingredients in the composition, the number of soiled dishes to be cleaned, the degree of soiling on the dishes, and the like. Generally, from about 0.01 ml to about 150 ml, preferably from about 3 ml to about 40 ml of a liquid detergent composition of the invention is combined with from about 2000 ml to about 20000 ml, more typically from about 5000 ml to about 15000 ml of water in a sink having a volumetric capacity in the range of from about 1000 ml to about 20000 ml, more typically from about 5000 ml to about 15000 ml. The soiled dishes are immersed in the sink containing the diluted compositions then obtained, where contacting the soiled surface of the dish with a cloth, sponge, or similar article cleans them. The cloth, sponge, or similar article may be immersed in the detergent composition and water mixture prior to being contacted with the dish surface, and is typically contacted with the dish surface for a period of time ranged from about 1 to about 10 seconds, although the actual time will vary with each application and user. The contacting of cloth, sponge, or similar article to the dish surface is preferably accompanied by a concurrent scrubbing of the dish surface.

Another method of the present invention will comprise immersing the soiled dishes into a water bath or held under running water without any liquid dishwashing detergent. A device for absorbing liquid dishwashing detergent, such as a sponge, is placed directly into a separate quantity of undiluted liquid dishwashing composition for a period of time typically ranging from about 1 to about 5 seconds. The absorbing device, and consequently the undiluted liquid dishwashing composition, is then contacted individually to the surface of each of the soiled dishes to remove said soiling. The absorbing device is typically contacted with each dish surface for a period of time range from about 1 to about 10 seconds, although the actual time of application will be dependent upon factors such as the degree of soiling of the dish. The contacting of the absorbing device to the dish surface is preferably accompanied by concurrent scrubbing.

Alternatively, the device may be immersed in a mixture of the hand dishwashing composition and water prior to being contacted with the dish surface, the concentrated solution is made by diluting the hand dishwashing composition with water in a small container that can accommodate the cleaning device at weight ratios ranging from about 95:5 to about 5:95, preferably about 80:20 to about 20:80 and more preferably about 70:30 to about 30:70, respectively, of hand dishwashing liquid:water respectively depending upon the user habits and the cleaning task.

EXAMPLES

The grease cleaning performance of hand dishwashing detergent compositions with and without polyetheramines according to the invention was evaluated. As it can be seen from the results below, compositions comprising the polyetheramines of the invention provide considerably greater grease removal than the same compositions without the polyetheramine.

Example 1

The following hand dishwashing detergent compositions were made:

TABLE 1

Dye, perfume and preservative
NaOH to pH 9 (10% in demin water)
Water to 100%
Numbers in weight % of the formula

| Ingredients | Composition A | Composition B | Composition C | Composition D |
|---|---|---|---|---|
| AES | 20.77 | 20.77 | 20.53 | 20.53 |
| C12/14 dimethyl amineoxide | 5.61 | 5.61 | 4.11 | 4.11 |
| Nonionic surfactant | 0.41 | 0.41 | 0.37 | 0.37 |
| PPG 2000 | 0.64 | 0.64 | 0.5 | 0.5 |
| Ethanol | 2.09 | 2.09 | 1.0 | 1.0 |
| NaCl | 1.10 | 1.10 | 0.5 | 0.5 |
| Phenoxyethanol | 0.15 | 0.15 | 0.15 | 0.15 |
| BEPPA 4.0 | | 1.0 | | |
| BEPPA 5.6 | | | | 1.0 |

AES: Alkyl ethoxy sulphate
PPG: polypropylene glycol (Molecular Weight 2000)

The polyetheramines tested were:

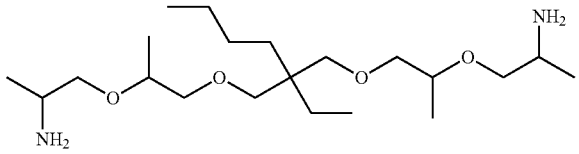

BEPPA 4.0: 2-butyl-2-ethyl-1,3-propane diol+4 mol propylene oxide, aminated

Synthesis of 1 mol of 2-Butyl-2-ethyl-1,3-propane diol+4 mol propylene oxide, aminated a) 1 mol 2-Butyl-2-ethyl-1,3-propane diol+4 mol propylene oxide In a 2 l autoclave 322.6 g 2-Butyl-2-ethyl-1,3-propane diol and 7.9 g KOH (50% in water) were mixed and stirred under vacuum (<10 mbar) at 120° C. for 2 h. The autoclave was purged with nitrogen and heated to 140° C. 467.8 g propylene oxide was added in portions within 6 h. To complete the reaction, the mixture was allowed to post-react for additional 5 h at 140° C. The reaction mixture was stripped with nitrogen and volatile compounds were removed in vacuo at 80° C. The catalyst potassium hydroxide was removed by adding 2.3 g synthetic magnesium silicate (Macrosorb MP5plus, Ineos Silicas Ltd.), stirring at 100° C. for 2 h and filtration. A yellowish oil was obtained (772.0 g, hydroxy value: 248.5 mgKOH/g).

b) 1 mol 2-Butyl-2-ethyl-1,3-propane diol+4 mol propylene oxide, aminated

In a 9 l autoclave 600 g of the resulting diol mixture from step a), 1250 g THF and 1500 g ammonia were mixed in presence of 200 ml of a solid catalyst as described in EP0696572B1. The catalyst containing nickel, cobalt, copper, molybdenum and zirconium was in the form of 3×3 mm tables. The autoclave was purged with hydrogen and the reaction was started by heating the autoclave. The reaction mixture was stirred for 18 h at 205° C., 5 the total pressure was maintained at 270 bar by purging hydrogen during the entire reductive amination step. After cooling down the autoclave the final product was collected, filtered, vented of excess ammonia and stripped in a rotary evaporator to remove light amines and water. A total of 560 grams of a low-color etheramine mixture was recovered. The analytical results thereof are shown in the table below:

| Total amine-value mg KOH/g | Total acetylatables mg KOH/g | Secondary and tertiary amine value mg KOH/g | Tertiary amine-value mg KOH/g | Hydroxyl value mg KOH/g | Degree of amination in % | Primary Amine in % of total amine |
|---|---|---|---|---|---|---|
| 277.66 | 282.50 | 4.54 | 0.86 | 5.70 | 98.59 | 98.36 |

BEPPA 5.6: 2-butyl-2-ethyl-1,3-propanediol+5.6 mol propylene oxide, aminated

Synthesis of 1 mol of 2-butyl-2-ethyl-1,3-propanediol+5.6 mol propylene oxide, aminated a) 1 mol 2-butyl-2-ethyl-1,3-propanediol+5.6 mol propylene oxide In a 2 l autoclave 313.1 g 2-Butyl-2-ethyl-1,3-propanediol and 3.8 g KOH (50% in water) were mixed and stirred under vacuum (<10 mbar) at 120° C. for 2 h. The autoclave was purged with nitrogen and heated to 140° C. 635.6 g propylene oxide was added in portions within 6 h. To complete the reaction, the mixture was allowed to post-react for additional 5 h at 140° C. The reaction mixture was stripped with nitrogen and volatile compounds were removed in vacuo at 80° C. The catalyst was removed by adding 50.9 g water and 8.2 g phosphoric acid (40% in water) stirring at 100° C. for 0.5 h and dewatering in vacuo for 2 hours. After filtration, 930.0 g of light yellowish oil was obtained (hydroxy value: 190 mgKOH/g).

b) 1 mol 2-butyl-2-ethyl-1,3-propanediol+5.6 mol propylene oxide, aminated

The amination of the product of step a) (1 mol 2-butyl-2-ethyl-1,3-propanediol+5.6 mole 5 propylene oxide) was conducted in a tubular reactor (length 500 mm, diameter 18 mm) which had been charged with 15 mL of silica (3×3 mm pellets) followed by 70 mL (74 g) of the catalyst precursor (containing oxides of nickel, cobalt, copper and tin on gama-Al2O3, 1.0-1.6 mm split-prepared according to WO 2013/072289 A1) and filled up with silica (ca. 15 mL).

The catalyst was activated at atmospheric pressure by being heated to 100° C. with 25 Nl/h of nitrogen, then 3 hours at 150° C. in which the hydrogen feed was increased from 2 to 25 Nl/h, then heated to 280° C. at a heating rate of 60° C. per hour and kept at 280° C. for 12 hours.

The reactor was cooled to 100° C., the nitrogen flow was turned off and the pressure was increased to 120 bar. The catalyst was flushed with ammonia at 100° C., before the temperature was increased to 206° C. and the alcohol feed was started with a WHSV of 0.19 kg/liter*h (molar ratio ammonia/alcohol=55:1, hydrogen/alcohol=11.6:1). The crude material was collected and stripped on a rotary evaporator to remove excess ammonia, light weight amines and reaction water to afford (1 mol 2-butyl-2-ethyl-1,3-propanediol+5.6 mole propylene oxide, aminated). The analytical data of the reaction product is shown in the table below.

| Total amine-value mg KOH/g | Total acetylatables mg KOH/g | Secondary and tertiary amine value mg KOH/g | Tertiary amine-value mg KOH/g | Hydroxyl value mg KOH/g | Degree of amination in % | Primary Amine in % of total amine |
|---|---|---|---|---|---|---|
| 222.92 | 231.50 | 2.57 | 0.31 | 8.89 | 96.16 | 98.85 |

The grease cleaning performance of the compositions was assessed by measuring the turbidity of wash solutions of the compositions upon contact with grease.

Methodology

Grease (beef fat) is liquefied by heating and small amounts are put in small glass vials and left at 4° C. for at least 24 hours. The day before the test, the vials with the grease are put at 21° C. to equilibrate. 5% wash solutions (water hardness: 14 dH) of the hand dishwashing detergent compositions as shown in Table 1 are added to the vial containing the grease. Turbidity/absorbance of the wash solutions is measured over time at 25° C., under mild stirring conditions via a small overhead stirrer. Cleaning indexes are calculated with reference to the compositions free of polyetheramine: (Absorbance of the test solution with polyetheramine/absorbance of the reference solution without polyetheramine)*100. The higher the Cleaning Index, the better the grease cleaning performance of the polyetheramine.

| | Composition A | Composition B | Composition C | Composition D |
|---|---|---|---|---|
| Absorbances at 2/5/15/20 min | 0.22/0.34/0.56/0.63 | 0.28/0.44/0.67/0.76 | 0.07/0.09/0.12/0.14 | 0.08/0.11/0.19/0.22 |
| Cleaning Indices at 2/5/15/20 min | 100/100/100/100 | 127/129/120/121 | 100/100/100/100 | 114/122/158/157 |

Example 2

Following hand dishwashing detergent compositions were made:

TABLE 2

Dye, perfume and preservative
NaOH to pH 9 (10% in demin water)
Water to 100%
Numbers in weight % of the formula

| Ingredients | Composition E | Composition F | Composition G | Composition H |
|---|---|---|---|---|
| AES | 21.41 | 21.41 | 16.79 | 16.79 |
| C12/14 dimethyl amineoxide | 4.86 | 4.86 | 1.91 | 1.91 |
| Nonionic surfactant | 0.43 | 0.43 | — | — |
| PPG 2000 | 0.40 | 0.40 | 0.20 | 0.20 |
| Ethanol | 2.36 | 2.36 | — | — |
| NaCl | 0.80 | 0.80 | 1.00 | 1.00 |
| Phenoxyethanol | 0.15 | 0.15 | 0.18 | 0.18 |
| PEI | 0.25 | 0.25 | — | — |
| BEPPA 2.0 | | 2.00 | | 2.00 |

PEI: alkoxylated polyethyleneimine polymer

Methodology

Grease (beef fat) is liquefied by heating and polystyrene sticks coated with paraffin wax are dipped in the liquid grease, so that grease-covered sticks are obtained. The grease-covered sticks are stored at 4 C for minimum 24 hours. For measuring the grease cleaning performance of the compositions, the grease-covered sticks are placed over a slightly moving/swirling microplate containing 10% wash solutions of the compositions (water hardness: 14 dH). The grease-covered sticks are dipping into the test solutions without getting in contact with the walls or bottom of the microplate and are kept in the swirling test solutions during the wash time. The wash temperature is 30 C. The turbidity of the test solutions is quantified via measuring the absorbance of the test solutions and from the measured absorbance the cleaning index is calculated: (Absorbance of the test solution with polyetheramine/absorbance of the reference solution without polyetheramine)*100. The higher the Cleaning Index, the better the grease cleaning performance of the polyetheramine.

| | Composition E | Composition F | Composition G | Composition H |
|---|---|---|---|---|
| Cleaning Index at 15 min | 100 | 121 | 100 | 163 |

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A hard surface cleaning composition comprising:

a) from about 1% to about 60% by weight of the composition of a surfactant system comprising an anionic surfactant and a primary co-surfactant selected from the group consisting of amphoteric, zwitteronic and mixtures thereof; and b) from about 0.1% to about 10% by weight of the composition of a polyetheramine of Formula (I):

Formula (I)

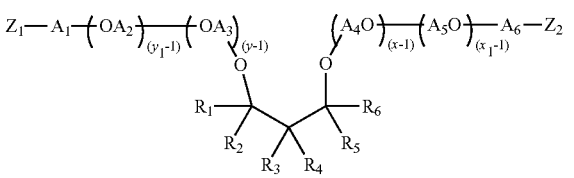

wherein $R_3$ is ethyl, $R_4$ is butyl, and each of $R_1$, $R_2$, $R_5$, and $R_6$ is H, each of $A_1$-$A_6$ is independently selected from linear or branched alkylenes having about 2 to about 18 carbon atoms, each of $Z_1$-$Z_2$ is independently selected from OH or $NH_2$, wherein at least one of $Z_1$-$Z_2$ is $NH_2$, wherein the sum of x+y is in the range of 2 to about 200, wherein x≥1 and y≥1, and the sum of $x_1+y_1$ is in the range of 2 to about 200, wherein $x_1 \geq 1$ and $y_1 \geq 1$.

2. A composition according to claim 1 wherein in said polyetheramine of Formula (I), each of $A_1$-$A_6$ is independently selected from ethylene, propylene, or butylene.

3. A composition according to claim 1 wherein the polyetheramine of Formula (I) has a weight average molecular weight of less than about 1000 grams/mole.

4. A hard surface cleaning composition comprising:

a) from about 1% to about 60% by weight of the composition of a surfactant system comprising an anionic surfactant and a primary co-surfactant selected from the group consisting of amphoteric, zwitteronic and mixtures thereof; and from about 0.1% to about 10% by weight of the composition of a polyetheramine having the following formula:

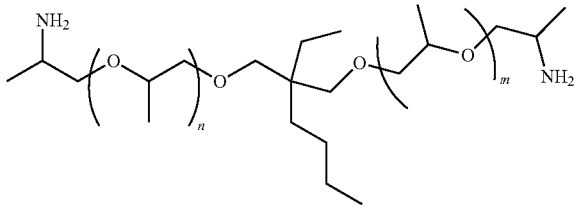

wherein n+m is from about 0 to about 8.

5. A composition according to claim 1 wherein the anionic surfactant is selected from the group consisting of alkyl sulfate, alkyl alkoxy sufate, alkyl benzene sulfonate, paraffin sulfonate and mixtures thereof.

6. A composition according to claim 1 wherein the anionic surfactant is a mixture of alkyl sulfate and alkyl alkoxy sufate and wherein the alkyl alkoxy sulfate is an alkyl ethoxy sulfate.

7. A composition according to claim 1 wherein the primary co-surfactant comprises an amphoteric surfactant and wherein the amphoteric surfactant comprises at least about 60% by weight thereof of an amine oxide surfactant.

8. A composition according to claim 1 wherein the primary co-surfactant comprises an amphoteric and a zwitterionic surfactant and wherein the amphoteric and the zwitterionic surfactant are present in a weight ratio of from about 2:1 to about 1:2.

9. A composition according to claim 1 wherein the surfactant system further comprises a non-ionic surfactant.

10. A composition according to claim 1 wherein the composition further comprises a magnesium salt.

11. A composition according to claim 1 wherein the composition further comprises an aminocarboxylate chelant.

12. A composition according to claim 1 wherein the composition further comprises an isothiazolinone based preservative.

13. A composition according to claim 8 wherein the amphoteric surfactant is an amine oxide surfactant and the zwitteronic surfactant is a betaine.

* * * * *